US005526761A

United States Patent [19]

Mulcahey et al.

[11] Patent Number: 5,526,761

[45] Date of Patent: *Jun. 18, 1996

[54] METHOD AND APPARATUS FOR CLOSING MATTRESSES

[75] Inventors: Charles E. Mulcahey, Beverly; Michael R. Porter, Topsfield; John J. Kirby, South Hamilton, all of Mass.

[73] Assignee: Porter Sewing Machines, Inc., Beverly, Mass.

[ * ] Notice: The term of this patent shall not extend beyond the expiration date of Pat. No. 5,309,854.

[21] Appl. No.: 210,582

[22] Filed: Mar. 17, 1994

Related U.S. Application Data

[63] Continuation-in-part of Ser. No. 854,373, Mar. 19, 1992, Pat. No. 5,309,854.

[51] Int. Cl.[6] ..... D05B 27/04

[52] U.S. Cl. ..... 112/475.01; 112/475.08; 112/314

[58] Field of Search ..... 112/312, 313, 112/2.1, 10, 262.2, 262.1, 475.01, 475.08

[56] References Cited

U.S. PATENT DOCUMENTS

| | | |
|---|---|---|
| Re. 24,005 | 11/1951 | Knaus . |
| 722,014 | 3/1903 | Harmon . |
| 1,006,827 | 10/1911 | Chauvet et al. . |
| 1,109,635 | 9/1914 | Moffat . |
| 1,139,863 | 5/1915 | Hayes, Jr. . |
| 1,217,329 | 2/1917 | Moffat . |

(List continued on next page.)

FOREIGN PATENT DOCUMENTS

| | | |
|---|---|---|
| 07-9064 | 7/1932 | Japan . |
| 47-15384 | 5/1972 | Japan . |
| 47-18308 | 5/1972 | Japan . |
| 47-18310 | 5/1972 | Japan . |
| 48-6892 | 2/1973 | Japan . |
| 49-37149 | 4/1974 | Japan . |
| 50-8653 | 1/1975 | Japan . |
| 50-11755 | 2/1975 | Japan . |
| 50-72451 | 6/1975 | Japan . |
| 50-146759 | 12/1975 | Japan . |
| 51-4855 | 2/1976 | Japan . |
| 51-98743 | 8/1976 | Japan . |
| 52-17055 | 2/1977 | Japan . |
| 53-25149 | 3/1978 | Japan . |
| 53-33746 | 3/1978 | Japan . |
| 54-143520 | 5/1979 | Japan . |
| 54-92329 | 5/1979 | Japan . |

OTHER PUBLICATIONS

Tokyo Juki Industrial Co., Ltd., Parts book for model DLU–450 sewing machines, 1977–12.

Tokyo Juki Industrial Co., Ltd., Parts book for model LU–562 and LU–563 sewing machines, 1978–9.

Tokyo Juki Industrial Co., Ltd., Parts book for model MO–814 and MO–816 sewing machines, revision No. 3.

Tokyo Juki Industrial Co., Ltd., Engineer's Manual for MOU–800 series Variable Top Feed Overedger and Safety Stitcher sewing machine, No. III–8.

Tokyo Juki Industrial Co., Ltd., Parts book for model MOU–800 series Variable Top Feed Overredger and Safety Stitcher sewing machine and TO12C Automatic Chain–off Thread Trimmer Sewing machine, 1980–4.

Tokyo Juki Industrial Co., Ltd., Parts book for models MO–804, Mo–814 and Mo–816 sewing machines, 1978–5.

(List continued on next page.)

*Primary Examiner*—C. D. Crowder
*Assistant Examiner*—Paul C. Lewis
*Attorney, Agent, or Firm*—Wolf, Greenfield & Sacks

[57] ABSTRACT

A method for forming a partial mattress sack which prevents radial bunching includes feeding first and second panels having different edge lengths at different rates through a sewing machine to form the partial mattress sack. An apparatus for sewing the partial mattress sack includes a mechanism for driving upper and lower walking feet at varying rates and a mechanism for driving the upper walking foot at the same speed as a second lower walking foot.

14 Claims, 12 Drawing Sheets

U.S. PATENT DOCUMENTS

| | | | |
|---|---|---|---|
| 1,243,160 | 10/1917 | Grieb . | |
| 2,549,057 | 5/1943 | Chinnici . | |
| 2,777,409 | 1/1957 | Winberg . | |
| 2,827,869 | 6/1956 | Nering . | |
| 2,869,493 | 1/1959 | Seavert . | |
| 2,925,057 | 2/1960 | Cash . | |
| 2,967,498 | 5/1958 | Russell et al. . | |
| 3,083,654 | 4/1963 | Cash . | |
| 3,162,158 | 7/1963 | Chudner . | |
| 3,262,410 | 7/1966 | Chernes . | |
| 3,530,809 | 9/1990 | Porter . | |
| 3,611,817 | 5/1969 | Smith et al. . | |
| 3,636,899 | 1/1972 | Crisler . | |
| 3,641,954 | 2/1972 | Kalning et al. . | |
| 3,995,571 | 12/1976 | Porter . | |
| 4,014,274 | 3/1977 | Kosakai . | |
| 4,043,282 | 8/1977 | Fanghanel . | |
| 4,067,269 | 1/1978 | Fanghanel . | |
| 4,155,317 | 5/1979 | Enomoto . | |
| 4,166,422 | 9/1979 | Porter . | |
| 4,274,345 | 6/1981 | Schneider et al. | 112/312 X |
| 4,285,294 | 8/1981 | Aida . | |
| 4,449,464 | 5/1984 | Porter . | |
| 4,546,716 | 10/1985 | Babson et al. . | |
| 4,589,364 | 5/1986 | Yamamoto et al. . | |
| 4,821,656 | 4/1989 | Dordi et al. . | |
| 4,905,615 | 3/1990 | Pofferi . | |
| 5,014,635 | 5/1991 | Ochi et al. | 112/313 X |
| 5,056,441 | 10/1991 | Seago . | |
| 5,309,854 | 5/1994 | Mulcahey et al. . | |

OTHER PUBLICATIONS

Tokyo Juki Industrial Co., Ltd., Parts book for models MOR–2500, NOU–2500, MOR–2514–OD4–300, MOR–2514–BD4–307, MOR–2516–DD4–300, NOU–2514–BD4–307 and MOU–2516–DD4–300, 1984–3.

Union Special Machine Company catalog 103S, for Streamlined High Speed Overseamers, Mar. 1966.

Union Special Technical Information, No. 18, Jun. 23, 1978 re: Porter top feed mechanism.

Tokyo Juki Industrial Co., Ltd. Brochure for MOU–814 series and MOU–816 series Catalog (Jun. 1980).

Willcox & Gibbs Parts Catalog, for 4 series, Models: 503–4, 504–4, 512, 4–514–4, 515–4, 516–4, 8488, Cat. No. 8488, Sep., 1980.

Mitsubishi "Industrial Sewing Machine"—Technical Information–Label Holder Unit, MP–008 (for PLK–1210).

METHOD AND APPARATUS FOR CLOSING MATTRESSES

CROSS REFERENCE TO RELATED APPLICATION

This application is a continuation-in-part of U.S. application Ser. No. 07/854,373, filed Mar. 19, 1992, now U.S. Pat. No. 5,309,854 and entitled "High Lift Sewing Machine." The specification of application Ser. No. 07/854,373, is incorporated herein by reference.

FIELD OF THE INVENTION

This invention relates generally to a method and apparatus for closing mattress sacks and, more particularly, to a method and apparatus for closing mattresses in which the periphery of a top panel is longer than the edge of a side panel.

BACKGROUND OF THE INVENTION

Modern mattresses generally include an inner construction, covered by a mattress sack. A mattress sack is formed from a top and bottom panel and a side panel, joining the top and bottom panel.

Finished mattresses are generally heavy and bulky. This weight and bulk has a direct impact on manufacturing cost, because the weight and bulk are more likely to cause injury, for example. In addition, existing and future government regulations ("OSHA" regulations, for example) have provisions concerning the number of people necessary to flip mattresses.

While mattress manufacturers desire lower cost manufacturing processes, they also demand a product with high quality sizing. For example, it is generally understood that it is relatively simple to attach a top panel of a first peripheral length and side panel having a same length edge. However, such a construction produces an unacceptable product. This is so, because the final construction is susceptible to unsightly "radial bunching" of the side panel when the mattress is loaded, for example if a person sits on the mattress (radial bunching refers to the effect produced when the side panel bunches outwardly and radially). To avoid bunching, mattress manufacturers attach the top and bottom panels of a first peripheral length with a side panel having a shorter edge length. This, however, has been performed manually with skilled labor, which increases the manufacturing costs. In such operations, a skilled operator pulls on the side panel, while pushing and manipulating the top panel to fit the two together. This is usually done with known tape-edge closing machines having a sewing machine and track mechanism. The operator follows the machine around the periphery of the mattress first manually fitting the side panel and top panel in conjunction with the machine. Then, the mattress is flipped, and the operator follows the machine around the periphery of the mattress manually fitting the side panel and bottom panel. As a result, the skilled fitter is needed to fit both edges, i.e., the top and side, and the bottom and side.

Accordingly, it is an object of the invention to provide a method and apparatus for forming partial sacks having a top panel with a peripheral edge length and a side panel with a shorter edge length so that manual fitting need be done for one edge only.

SUMMARY OF THE INVENTION

These and other objects are achieved with the present invention. A preferred embodiment of the present invention includes a conventional sewing machine with certain modifications, described below, that allow a top panel of a first edge length to be joined with a side panel of a second edge length. Consequently, a partial sack may be formed. The inner construction is then placed in the partial sack, and then a bottom panel is attached.

In a preferred embodiment, the conventional machine implements a known so-called safety stitch. The machine includes a high lift feeding mechanism to allow thick materials to be joined.

The feeding mechanism is constructed of an upper feed foot and a lower feed foot. The upper foot grabs a top panel, and the lower foot grabs the side panel. Modifications are made to the feeding apparatus of the conventional machine to implement a variable overfeed. In particular, the bottom feed operates at a fixed rate, and the top feed operates at a rate that is adjustable. The overfeed receives the top panel at a first rate and the side panel at a second rate. The ratio of the two rates corresponds to the ratio of the two lengths. The overfeed mechanism is pneumatically controlled by the user so that different rates of overfeed may be conveniently selected. The pneumatic control is responsive to user inputs and a foot pedal.

Another aspect of the invention includes a drag mechanism in the feeding path of the side panel to provide a drag to the side panel that is stitched to the top panel. The drag mechanism is pneumatically controllable by the user.

BRIEF DESCRIPTION OF THE DRAWINGS

The invention will be more fully appreciated from the following detailed description when taken in conjunction with accompanying drawings, in which.

DETAILED DESCRIPTION

Certain features of this invention were described in a commonly owned, co-pending U.S. patent application, Ser. No. 07/854,373, which is specifically incorporated herein by reference. In particular, application Ser. No. 07/854,373 discussed certain modifications to an overcast stitch machine such as the model 515-4-26 sewing machine sold by Pfaff Pegasus of U.S.A. of Atlanta, Ga. This application, on the other hand, relates to certain other modifications to the model 515-4-26 machine to implement a high lift safety stitch. In addition, the present invention relates to a method of employing the modified model 515-4-26 machine to form a partial mattress sack. The machine, as modified, requires less labor to produce a partial sack having a side edge length less than the peripheral edge length of the top panel so that the sack is less susceptible to radial bunching and the like.

Figure 1:
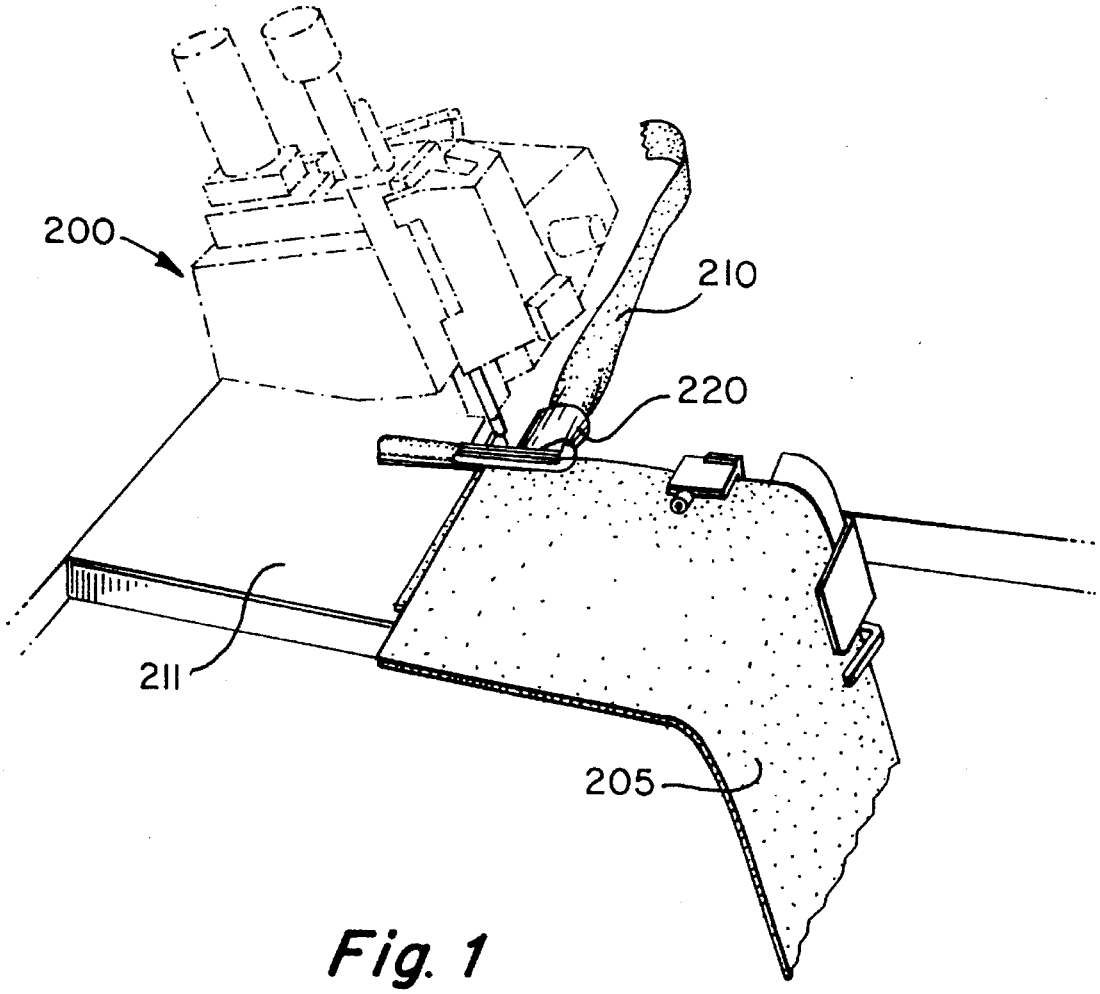
FIG. 1 is a perspective topside view of an apparatus according to the invention.

FIG. 1 is a perspective view, illustrating stitcher 200, receiving binding tape 210, and top panel 205 in relation to surface 211. The side panel 206 is received underneath and is shown more particularly in FIG. 11.

A tape folder 220 of conventional design folds tape 210 so that tape 210 may be placed around the respective edges of the top panel 205 and side panel 206. Stitcher 200 then joins the tape 210, top panel 205, and side panel 206 with a so-called "safety stitch." The mechanisms for performing a safety stitch are well known and will not be discussed herein except to the extent that they are material to a description of the invention.

Figure 2:
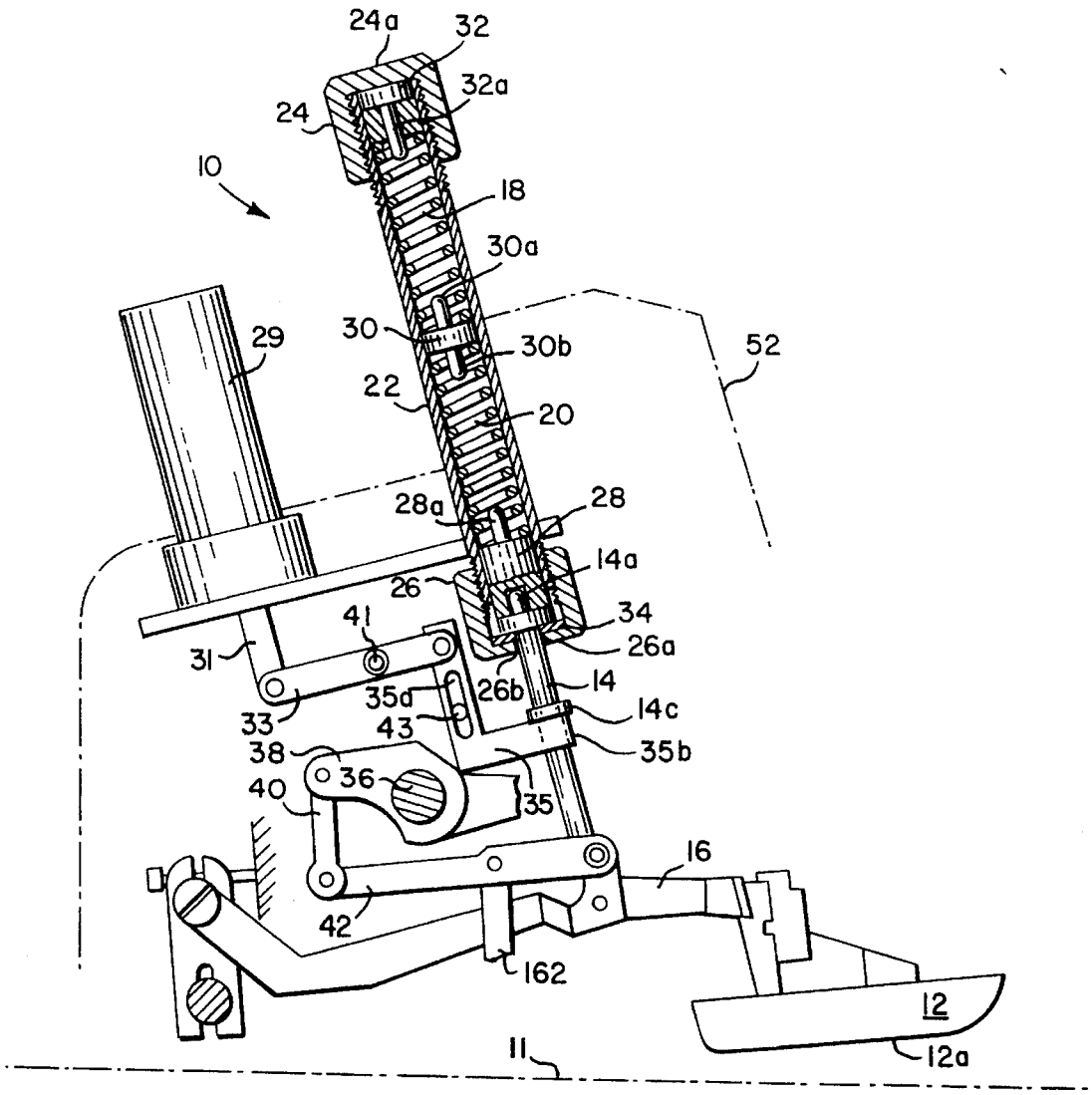
FIG. 2 is a simplified side view of the sewing machine of the present invention in partial cross-section illustrating the presser foot biasing structure of the present invention.

FIG. 2 is a simplified side view, in partial cross-section, of an exemplary mechanism for causing the presser foot 12 of a sewing machine to reciprocate in vertical motion to clamp the material to the throat plate when the needle is in the material and to rise and release the material when the needle exits the material so that the material can be advanced by walking feet before the next stitch. The presser foot 12 is permanently biased downwardly by a biasing mechanism 10.

Floor **26*b* of cap nut 26 defines the downward-most position of presser foot arm 14 and thus presser foot 12. The spring lengths and spacer lengths are chosen such that the springs are at least slightly compressed when transverse flange 14*a* of rod 14 is in its downwardmost position in which flange 14*a* abuts against the floor 26*b* of bottom cap nut 26. A cushioning member such as polyurethane pad 34 is attached to the inner surface of floor 26*b* so as to cushion the impact of flange 14*a* against the floor 26*b***.

Longitudinal flanges **28*a*, 30*a*, 30*b* and 32*a* of the spacers 28, 30 and 32 assist in preventing the springs from bending since they extend through the center of the helical springs. Accordingly, the longitudinal flanges 28*a*, 30*a*, 30*b* and 32*a*** should be as long as possible.

The length of the flanges, however, is limited by the uppermost possible position of rod 14. That is, for instance, if the spring is compressed enough, the top part of flange **28*a* will hit the bottom part of flange 30*b*. Accordingly, these flanges must be short enough such that they will not prevent the rod 14** from reaching what would otherwise be its uppermost possible position.

Since upper cap nut 24 can be easily removed from the tubular housing by unscrewing it, preload spacer 32 can be replaced quickly with a spacer of a different length when it is desired to change the downward compressor force of presser foot 12 as, for instance, may be the case when significantly changing the thickness of the material which is being sewed. As the material becomes increasingly thicker, the downward pressure of presser foot 12 on the material increases because the spring will be compressed more when presser foot 12 is resting on top of the material. Accordingly, in such a situation, if the force is too great, preload spacer 32 can be replaced with a shorter preload spacer thus reducing the compression of the springs. In fact, since upper cap nut 24 is removable the springs themselves can be easily replaced if desired.

Further, the lower travel limit of presser foot 12 is limited by the position of floor **26*b* of lower cap nut 26 and the thickness of polyurethane pad 34. Accordingly, by proper positioning of floor 26*b*, presser foot 12 can be prevented from crashing into the throat plate 11, thus reducing wear of the components of the machine. Since lower cap nut 26 is engaged to housing 22 by thread means, the height of floor 26*b* can be adjusted by screwing or unscrewing lower cap nut 26** to the desired extent.

Means are provided for manually lifting the presser foot 12 (and upper walking foot) prior to operation in order to initially insert the material to be sewed in the throat of the machine. A hydraulic cylinder 29 can be manually operated to raise the presser foot 12. Shaft 31 is coupled to presser foot connecting member 14 via arms 33 and 35. Connecting member 14 may be a cylindrical rod. Upon activation, shaft 31 is extended out of hydraulic cylinder 29 causing arm 33 to rotate counter-clockwise about pivot 41 thus lifting arm 35. End **35*b* of arm 35 extends below a flange 14*c* on rod 14 and lifts presser foot rod 14 and presser foot 12 by exerting an upward force on flange 14*c*. Arm 35 is slotted at 35*a*. A pin 43 is fixedly attached to a wall behind arm 35 and extends through slot 35*a*. Thus, arm 35 can slide up and down and rotate about pin 43. As will be explained in greater detail with respect to FIGS. 5A and 5B, the upper walking foot is coupled to rod 14 via linkages 42 and 162 such that the lifting of presser foot rod 14 also lifts the upper walking foot. During a sewing operation, the presser foot 12 is urged upwardly at fixed intervals by a reciprocating drive shaft 36** as will be described in greater detail herein.

The presser foot 12 is coupled to connecting member or rod 14 by means of a presser foot arm 16. Rod 14 is biased downwardly by biasing means such as helical die springs 18 and 20 contained in tubular housing 22. Housing 22 includes upper cap nut 24 and lower cap nut 26. The ends of housing 22 are externally threaded so that the internally threaded cap nuts 24 and 26 can be screwed onto the opposing ends of housing 22. Roof **24*a* of upper cap nut 24 is solid. Floor 26*a* of lower cap nut 26 comprises an opening 26*b* through which rod 14 slideably travels. The upper portion of rod 14 includes a transverse flange 14*a* which is wider than opening 26*b* such that the flange cannot pass through hole 26*b*, thereby trapping the upper portion of rod 14 within the presser foot biasing mechanism 10. A longitudinal flange 14*b* extends upwardly from rod 14 and fits within a slot in spacer 28. Spacer 28 includes a longitudinal flange 28*a* which extends upwardly through the center of helical spring 23. A second spacer 30 is positioned between helical springs 18 and 20 and has opposing flanges 30*a* and 30*b* extending therefrom through the centers of springs 18 and 20, respectively. A preload spacer 32 is positioned between the upper end of spring 18 and roof 24***a* of upper cap nut 24. Longitudinal flange 32*a* extends from preload spacer 32 through the center of helical spring 18.

Figure 3:
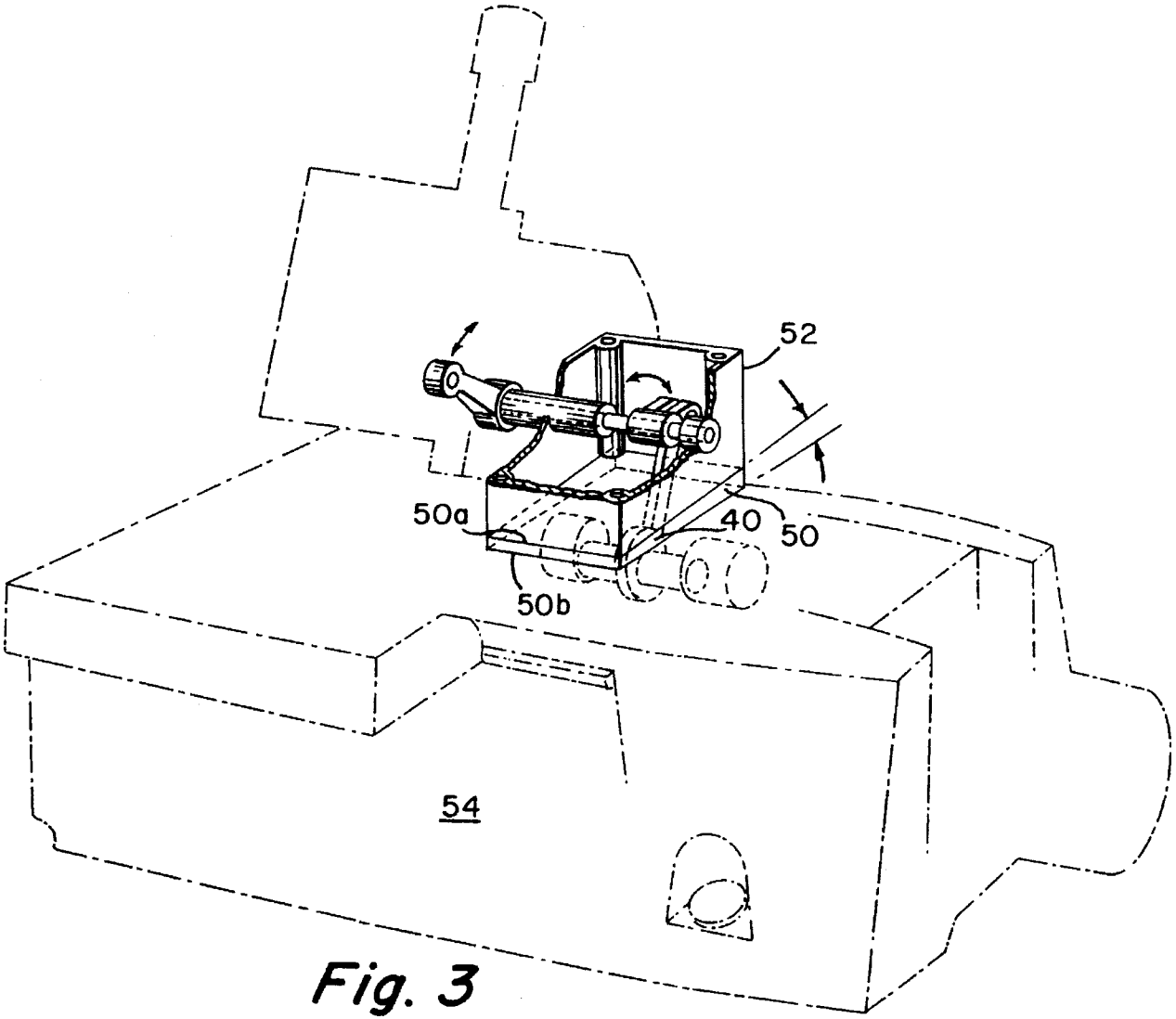
FIG. 3 is perspective view illustrating a trapezoidal wedge used to increase the clearance of the needle, presser foot and upper walking foot of the sewing machine of the present invention.
Figure 5A:
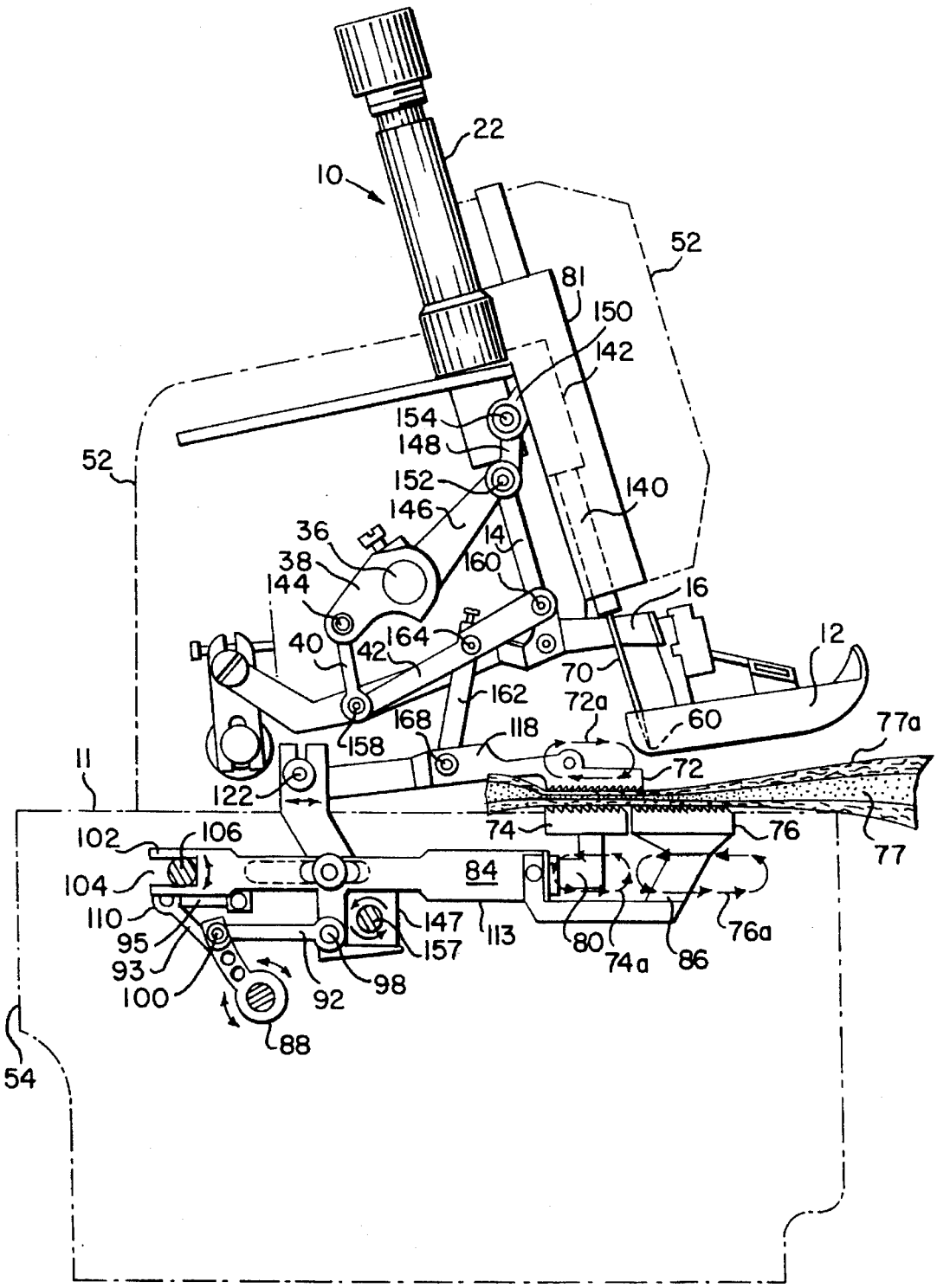
FIG. 5A is a simplified cut away side view of the mechanism for operating the presser foot, needle, and walking feet of the sewing machine of the present invention when the machine is in a first condition.
Figure 5B:
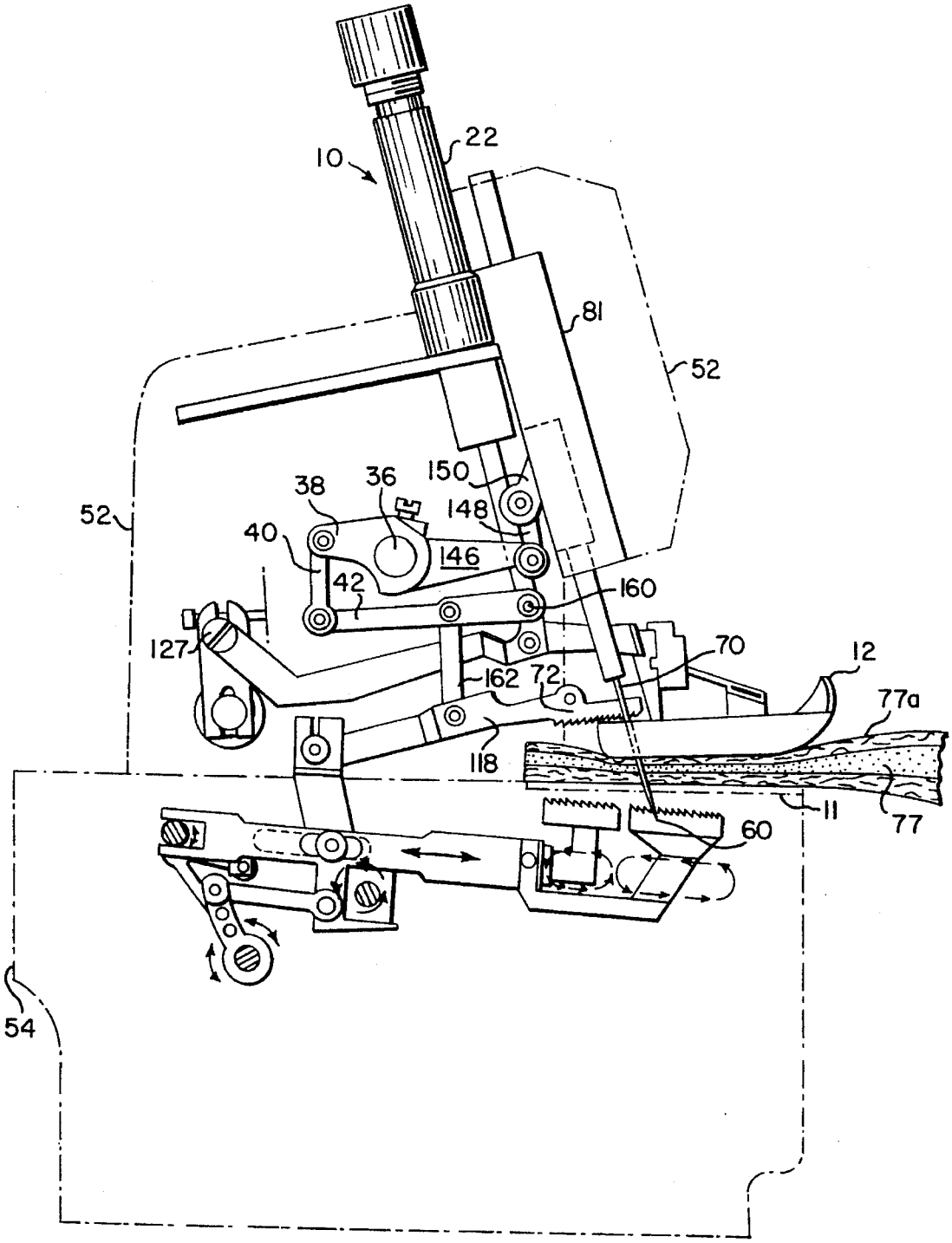
FIG. 5B is a simplified cut away side view of the mechanism for operating the presser foot, needle, and walking feet of the sewing machine of the present invention when the machine is in a second condition.

FIG. 3 illustrates another aspect of the improvements made to the Pegasus machine. FIG. 3 is a perspective view of the sewing machine illustrating the trapezoidal wedge 50 used to increase the throat clearance of the sewing machine. Wedge 50 is also shown in cross-section in FIGS. 7A and 7B. In accordance with the present invention, wedge 50 is inserted between the needle housing 52 and the main housing 54. The needle guide shaft, the hollow tubular shaft through which the needle travels, as well as the needle drive shaft 36 are fixedly attached to the upper housing. The needle guide shaft does not appear in FIG. 3, but is shown in FIGS. 5A and 5B and is designated with reference number 81. The raising and tilting of needle housing 52 by the insertion of trapezoidal wedge 50, thus raises and tilts the needle.

Figure 4:
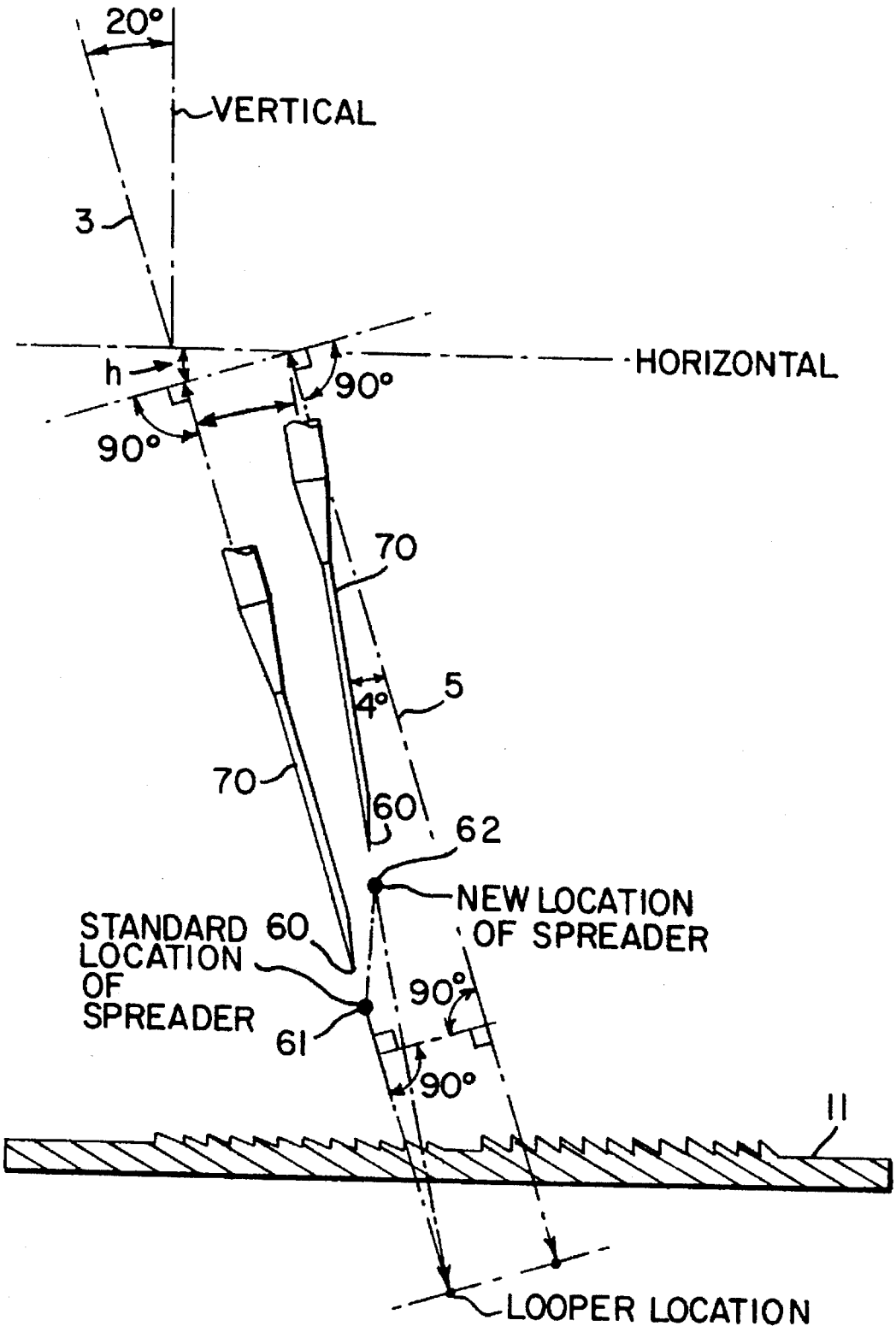
FIG. 4 is side view illustrating the relative relocation of the needle accomplished by the insertion of the wedge shown in FIG. 2 in the sewing machine of the present invention.

As illustrated in FIG. 4, in the original Pegasus sewing machine, the needle is angled from the vertical by approximately 20°. Thus, if the height of the needle is raised without changing the angle of the needle, the needle will travel in a path along line 5 in FIG. 4 parallel to its original path along line 3 but displaced therefrom by a predetermined distance perpendicular to the original path. The upper travel limit of the needle tip (as well as the lower travel limit) is raised by height h in FIG. 4. However, if the angle of the needle is not changed, the needle will not meet the spreader or the looper in the original locations. The shift in the needle path is not too significant with respect to meeting with the looper. The looper typically has a fairly long horizontal throw and will still be able to catch the thread off of the needle, particularly if the throw of the needle is increased so that the lower travel limit of the needle is not significantly changed in the vertical direction from the original needle path.

Figure 7B:
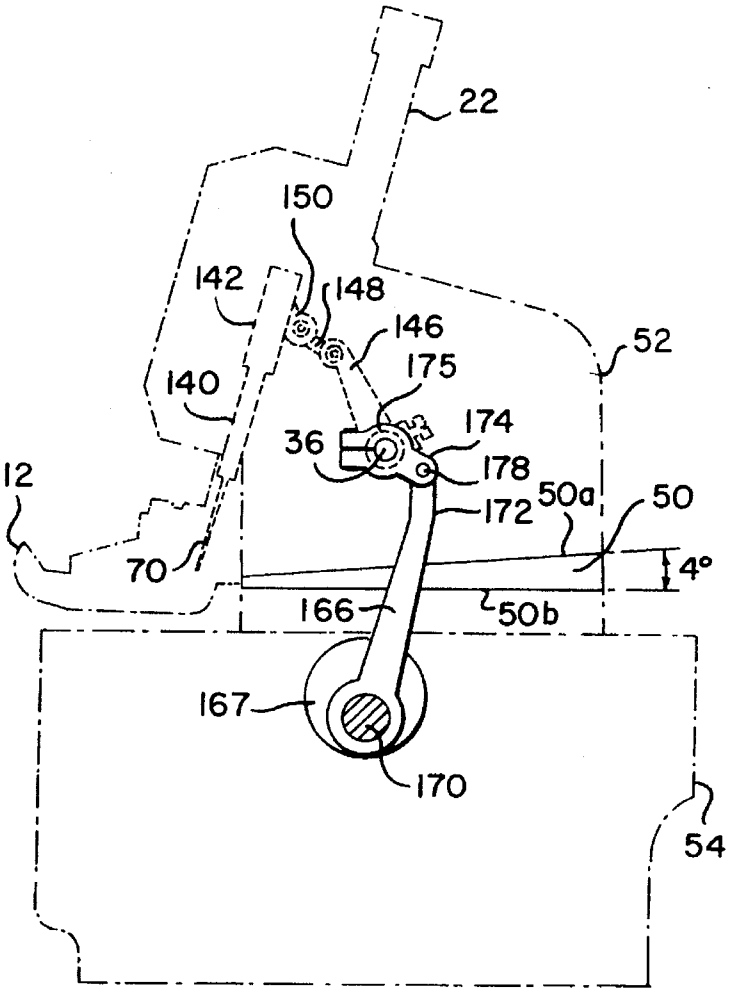
FIGS. 7A and 7B are simplified cut away side views showing the mechanism for driving the needle drive shaft in the present invention at two different instances during the drive cycle.
Figure 7A:
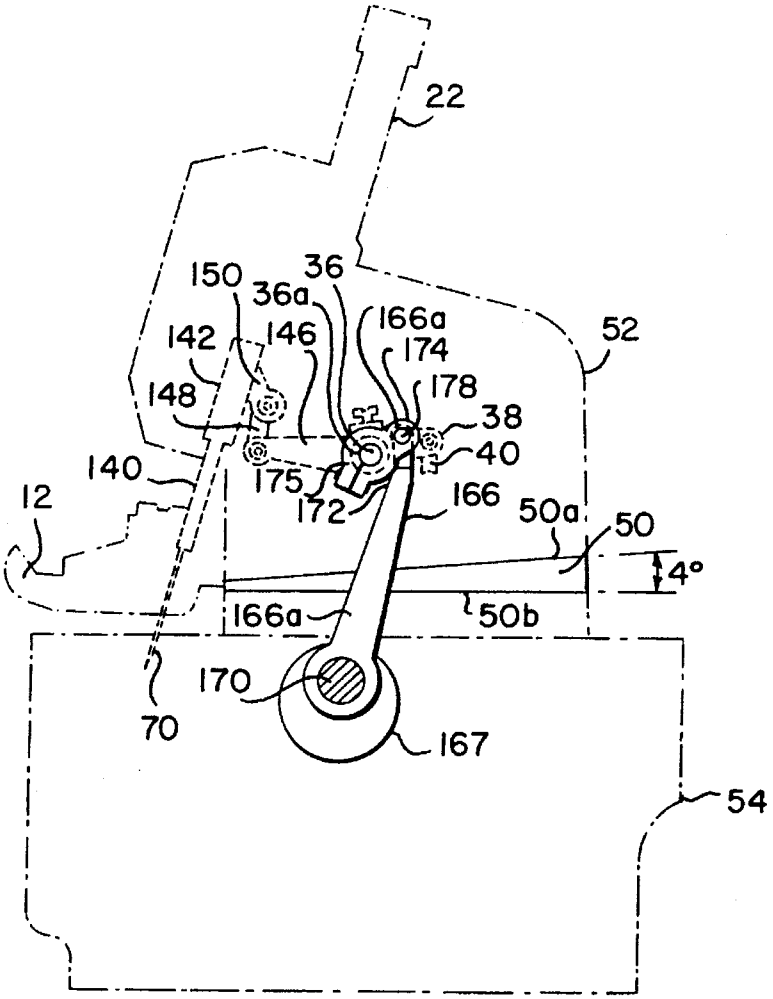

However, the relative position of the needle and spreader when they are to exchange thread must be maintained to a fairly high tolerance. As will be described herein in greater detail with respect to FIGS. 8A and 8B, the path of the spreader has also been modified in the present invention such that the spreader should now meet the needle at point 62 as opposed to point 61. As shown in FIG. 4, point 62 would not be on the path traversed by the needle if its angle was not changed. In order to cause the needle to still meet with the spreader within acceptable tolerance limits, the angle of the needle must be reduced about 4° from the vertical. Accordingly, the side cross-section of wedge 50 (as shown in FIGS. 7A and 7B) instead of being square, is trapezoidal, with the upper surface 50*a* angled about 4° relative to the bottom surface 50*b*.

Figure 6:
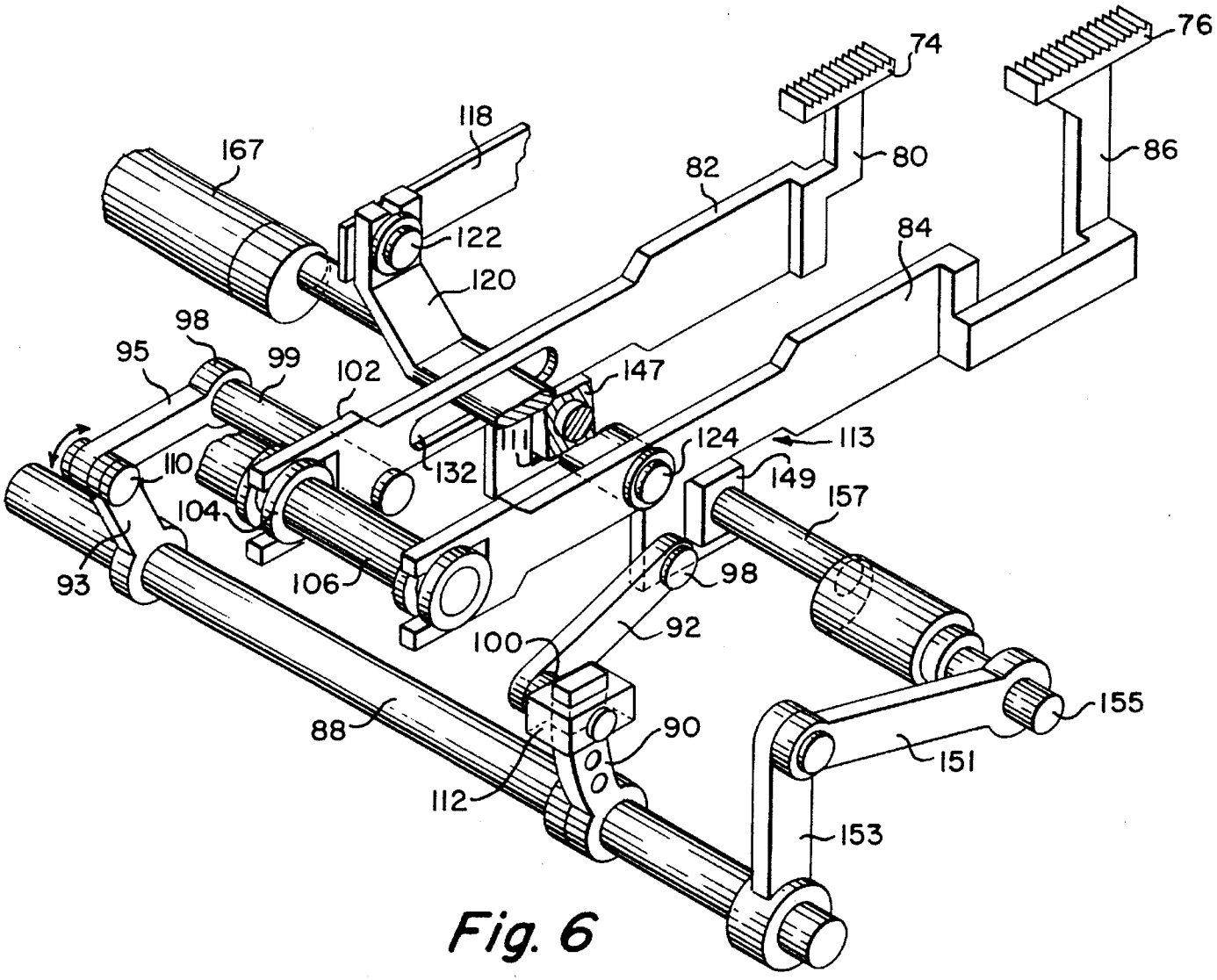
FIG. 6 is a detailed perspective view of the lower walking feet and walking feet mechanism of FIGS. 5A and 5B.

FIGS. 5A and 5B are simplified cut away side views of the sewing machine of the present invention at two different stages. FIGS. 5A and 5B are greatly simplified to ease the understanding of the invention. For instance, FIGS. 5A and 5B do not show the looper or the spreader. FIG. 6 is a simplified perspective view of some of the components in lower housing 54 of FIGS. 5A and 5B. In FIG. 5A, the needle is withdrawn from the material and the presser foot 12 is not engaged with the material. At this moment, upper walking foot 72 and lower walking feet 74 and 76 are engaged with the material and moving leftward in the figure. In FIG. 5B, the needle is in the material, the presser foot is clamping the material down to the throat plate and the upper and lower walking feet 72, 74 and 76 are not engaged with the material and are moving towards the right.

The desired cyclical movement of the needle, presser foot and all walking feet will be described at first without reference to the mechanical structure for causing the movement.

In general, one or more layers of material 77 are laid on the throat plate 11. Presser foot 12 is biased downwardly onto the upper surface 77*a* of the material and presses the material against throat plate 11. At this time, upper walking foot 72 is in its raised position so that it is not in contact with the material. Lower walking feet 74 and 75 are below the throat plate so that they do not engage the material. Presser foot 12 remains pressed against material 77 as the needle 70 advances in and through the material 77. Near the bottom of its travel limit, when the tip 60 of the needle is below the throat plate 11, a looper (not shown in FIGS. 5A and 5B) passes closely by the tip 60 of the needle to partially complete the stitch in a manner which is known in the art.

At essentially the same moment that the needle tip 60 exits from the material during its upward stroke (i.e., the point where the tip 60 of needle 70 is even with bottom surface 12*a* of presser foot 12), presser foot 12 begins to rise off of the material. Simultaneously, upper walking foot 72 lowers and lower walking feet 74 and 76 raise to engage the material. All of walking feet 72, 74 and 76 travel in elliptical paths illustrated by arrows 72*a*, 74*a* and 76*a*, respectively, in FIG. 5A such that when the walking feet are engaging the material, they are moving in the forward direction (i.e., to the left in FIGS. 5A and 5B) and thus advance the material. Due to the elliptical motion of the walking feet, they eventually disengage the material 77 and begin traveling rearward to be prepared to advance the material after the next stitch. Just before the walking feet disengage the material, presser foot 12 once again lowers into contact with the material starting the cycle all over again.

The mechanism for causing all of this action to occur at the appropriate instances will now be described in detail with respect to FIGS. 5A, 5B and 6. Primary lower walking foot 74 is coupled via arm 80 to primary lower walking foot bar 82. Secondary lower walking foot 76 is coupled via arm 86 to secondary lower walking foot bar 84. In the view of FIGS. 5A and 5B, bar 82 is directly behind, and therefore obscured by, bar 86. Both bars can be seen in FIG. 6.

The vertical component of the motion of primary lower walking foot 74 is provided by walking foot drive shaft 88 via arm 93 and linkage 95. Drive shaft 88 is driven to reciprocate approximately ¼ of a revolution by main drive shaft 167 via arms 151 and 153 and off center sub-shaft 155. This causes arm 93 to rock back and forth as illustrated by arrows 96. One end of linkage 95 is coupled to arm 93 at pivot 110 while the other end is coupled to primary walking foot bar 82 by pivot shaft 99 which is fixedly attached to bar 82 at one end and pivotally attached to linkage 95 by pivot 98 at the other end. End 102 of bar 82 comprises a slot 104 through which passes a fixed guide bar 106. Guide bar 106 fixes end 102 of bar 82 vertically, however, slot 104 allows bar 82 to slide horizontally relative to guide bar 106. Bar 82 slides horizontally in response to the motion of the walking foot drive shaft 88 transmitted to bar 82 via arm 93 and linkage 95.

Secondary lower walking foot bar 84 is driven off of shaft 88 via a second arm 90 and linkage 100. However, whereas in the primary lower walking foot mechanism, pivot 110 on arm 93 is fixed at a specified distance from drive shaft 88, in the secondary lower walking foot mechanism, pivot point 100 connecting arm 901to linkage 92 is adjustable. The specific mechanism utilized for adjusting pivot point 100 is not shown for ease of illustration. However, it should be understood that mounting box 112 can be loosened and slid up or down on arm 90 and then re-tightened to fix pivot point 100 at the desired distance on arm 90 from shaft 88. In this manner, the speed of secondary lower walking foot 76 can be changed relative to the speed of primary lower walking feet 74. This is the result of simply making the moment arms (i.e., the distance between the drive shaft 88 and the pivots 100 and 110) different. For instance, if the moment arm of the secondary walking foot is longer than the moment arm of the primary lower walking foot, then, for any given rotation of the drive shaft 88, pivot point 100 (and thus walking foot 76) will traverse a greater distance than pivot point 110 (and thus walking foot 74). Accordingly, secondary lower walking foot 76 will traverse a greater distance than primary lower walking foot 79 in the same period of time (i.e., it will travel faster).

As previously noted, the motion of walking feet 74 and 76 is not strictly horizontal but is elliptical, having a small vertical component. The vertical component of the motion of lower walking feet 74 and 76 is provided by off center sub-shaft 157 of main drive shaft 167. Unlike the other drive shafts discussed herein, main drive shaft 167 does not reciprocate but simply rotates in a clockwise direction. Blocks 147 and 149 are mounted on off center sub-shaft 157 and are positioned within horizontal slots 111 and 113 of bars 82 and 84, respectively. The rotation of main drive shaft 167 causes sub-shaft 157 and blocks 147 and 149 to travel in circles. The vertical component of the circular motion of blocks 147 and 149 is transmitted to bars 82 and 84. The horizontal component of their motion is not transmitted to the bars since blocks 147 and 149 can slide horizontally in slots 111 and 113, respectively.

The horizontal component of the elliptical motion of upper walking foot 72 is provided by connection of upper walking foot 72 via linkage 118 and arm 120 to secondary lower walking foot bar 84. As shown in FIG. 5A, linkage 118 is pivotally coupled to arm 120 by pivot 122. The other end of arm 120 is fixedly connected to bar 84 by pivot 124. Accordingly, as bar 84 moves horizontally, so does arm 120 and, consequently, linkage 118 and upper walking foot 72.

Due to the limited space available in the machine, a slot 132 was cut through primary lower walking foot arm 82 through which arm 120 passes. The slot is long enough to allow arm 120 to slide horizontally therein because secondary lower walking foot bar 84, to which arm 120 is rigidly attached, can move at a different rate of speed and traverse a different distance than arm 82, as previously discussed.

The motion of presser foot 12 and needle 70 as well as the vertical component of the motion of upper walking foot 72 now will be described in detail in relation to FIGS. 5A, 5B, 7A and 7B. Needle assembly 71 comprises needle 70, which is attached to a first needle bar 140, which, in turn, is attached to a second needle bar 142 of larger diameter. The needle assembly 71 is driven up and down by reciprocating needle drive shaft 36 via arm 146 and linkages 148 and 150. Arm 146 is rigidly attached to the drive shaft 36. Connection points 152 and 154 are pivots. Needle drive shaft 36 further drives presser foot 12 (upwardly only, since presser foot 12 is permanently biased downwardly by assembly 10) via arm 38, and linkages 40 and 42. Arm 38 is fixedly mounted to shaft 36. Connecting points 144, 158 and 160 are pivoting points. Point 160 is coupled to presser foot rod 14, which in turn is rigidly coupled to presser foot 12 via presser foot arm 16. Needle drive shaft 36 also provides the vertical component of the elliptical motion of upper walking foot 72 via arm 138, linkages 40, 42 and 162 and arm 118. Connections 164 and 168 are pivots.

As discussed with respect to FIGS. 2 and 3, the height of the needle 70 has been increased by the addition of a trapezoidal wedge between the needle housing and the lower housing. Consequently, the throw of needle 70 had to be increased so that it still extends below the throat plate at the bottom of its throw to meet with the looper. The throw of needle 70 is increased in the present invention by increasing the rotation of needle drive shaft 36. The driving mechanism for causing needle drive shaft 36 to rotate is not shown in FIGS. 5A and 5B. Instead reference is made to FIGS. 7A and 7B which are side views of the needle drive shaft and selected related components. Needle drive shaft 36 itself is driven off of the main drive shaft 167 via connecting member 166. The bottom of connecting member 166 is attached to main drive shaft 167 via off-center pivot 170. The rotation of main drive shaft 167 drives member 166 up and down in primarily vertical motion. Needle drive shaft 36 is driven by the vertical motion of the upper end 172 of connecting member 166 via arm 174. Arm 174 is fixedly attached to needle drive shaft 36 and pivotally attached to connecting member 166 by pivoting connection 178. The rotation of needle drive shaft 36 has been increased in accordance with the present invention by replacing the original arm coupling connecting member 166 to drive shaft 36 with the much shorter arm 174. Accordingly, the same vertical travel of connecting member 166 produces a greater rotation of shaft 36. In order to accommodate the much closer proximity of the upper end 172 of connecting member 166 to needle drive shaft 36, the diameter of needle drive shaft 36 arm 174 was reduced in the vicinity of arm 174 so as to prevent connecting member 166 from striking shaft 36 at the top of its motion. The original circumference of shaft 36 is shown by dotted circular line 175 in FIGS. 7A and 7B. As can be seen in FIG. 7A, when connecting member 166 is in its uppermost position, the inner side surface 166*a* of connecting member 166 would have contacted the needle drive shaft of original circumference (circular line 175). Accordingly, drive shaft 36 was reduced in diameter in the vicinity of arm 174 and connecting member 166 to have the circumference illustrated by solid circular line 36*a*.

In FIGS. 7A and 7B, arm 146 and related components for driving the needle as well as arm 38 and related components for driving the presser foot are shown in phantom. It should be understood that these components are displaced perpendicular to the surface of the page from connecting member 166, and arm 174 and, in the Pegasus sewing machine, are actually separated from each other by a plate through which the needle drive shaft 36 passes (see FIG. 3*b*, for instance). It should also be understood that the diameter of drive shaft 36 has not been changed at the point where arms 146 and 38 are coupled to it.

Connecting member 166 was also lengthened to accommodate for the raising of needle drive shaft 36 by the insertion of wedge 50 between the two housings.

Returning to FIGS. 5A and 5B, presser foot 12 is permanently biased downwardly by spring assembly 10 as previously described. When needle drive shaft 36 rotates in the counter-clockwise direction, an upward force is exerted on presser foot rod 14 by needle drive shaft 36 via arm 38 and linkages 40 and 42. As can be seen in FIG. 5A, when upper walking foot 72 meets the upper surface 77*a* of the material 77, walking foot 72 presses down against the material until a predetermined force is exerted and the downward force of foot 72 is cancelled out by the upward force of throat plate 11 and material 77. At this point, the downward motion of foot 72 and thus arm 118 is halted. This, in turn, cause pivot point 164 to become almost stationary (linkage 162 actually can rotate very slightly when arm 118 is stationary). After this condition is reached, further clockwise motion of needle drive shaft 36 continues to force pivot point 158 on linkage 42 downward. However, since point 164 is essentially fixed in space, arm 42 rotates counterclockwise around point 164, thus causing pivot point 160 at the opposite end of linkage 42 to rise. Pivot point 160 is coupled to presser foot rod 14. Accordingly, presser foot rod 14 (and presser foot 12) are forced upwardly to disengage the material. Accordingly, presser foot 12 does not begin to travel upwardly off of top surface 77*a* of material 77 until walking foot 72 engages the material. The length of the various linkages and arms are selected such that the needle has also disengaged the material at this point so that the walking feet advance the material (to the left in FIGS. 5A and 5B) only after the needle (and presser foot) have disengaged from the material.

Referring now to FIG. 5B, as the needle 70 plunges back into the material 77, a similar but opposite action occurs to that described above. When needle drive shaft 36 reaches the end of its counterclockwise reciprocation, it begins to rotate clockwise again urging needle 70 downwardly via arm 146 and linkages 148 and 150. This clockwise rotation of shaft 36 also causes linkage 42 to begin rotating clockwise around pivot point 164 urging presser foot 12 downwardly and eventually back into contact with the top surface 77*a* of the material. When the downward motion of presser foot 12 is halted by material 77, pivot point 160 at the end of arm 42 becomes fixed in space. Accordingly, at the point where the downward motion of presser foot 12 is halted by contact with the material, arm 42 continues to rotate in the clockwise direction, but it rotates about pivot point 160 instead of pivot point 164. Accordingly, pivot point 164 now begins to rise thus lifting upper walking foot 72 off of the material via linkage 162 and upper walking foot arm 118.

As noted above, needle drive shaft 36 has been raised by the addition of the wedge shown in FIG. 2. Accordingly, the maximum clearance of not only the needle but also the presser foot and the upper walking foot have been increased. The maximum clearance of the presser foot 12 increases as linkages 40 and 162 increase in length. Essentially, increasing the lengths of linkages 40 and 162 produces an increase in the throw of the presser foot which translates at least partially into an increase in its upper travel limit. The lower travel limit of presser foot 12 is dictated by the material 77, the throat plate 11,or the lower cap nut 26 of spring assembly 10, whichever is highest.

Figure 8:
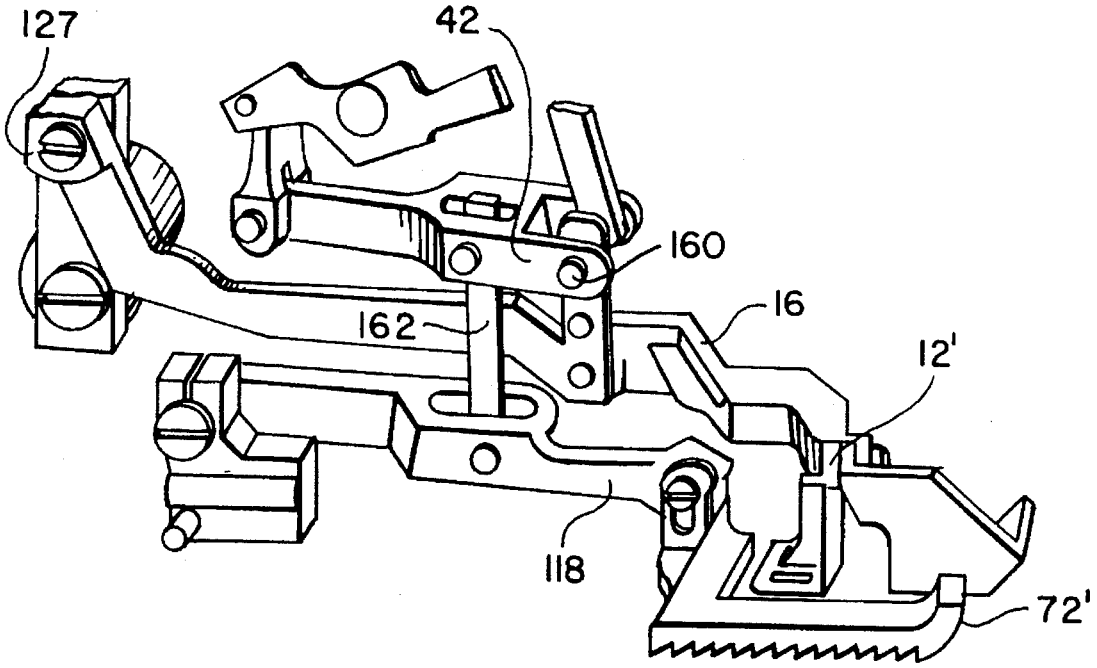
FIG. 8 illustrates a presser foot and top feed of the apparatus of FIG. 1.

According to a different embodiment of the invention, the modified machine is further modified with known techniques to implement a safety stitch, i.e., one needle and one looper. As such, a high lift safety stitch machine may be devised so that tape edge joining and the like may be performed. Referring to FIG. 8, an alternative presser foot 12' and top feed 72' are shown. The foot 12' and the feed 72' are the appropriate components for a safety stitch machine.

Figure 9:
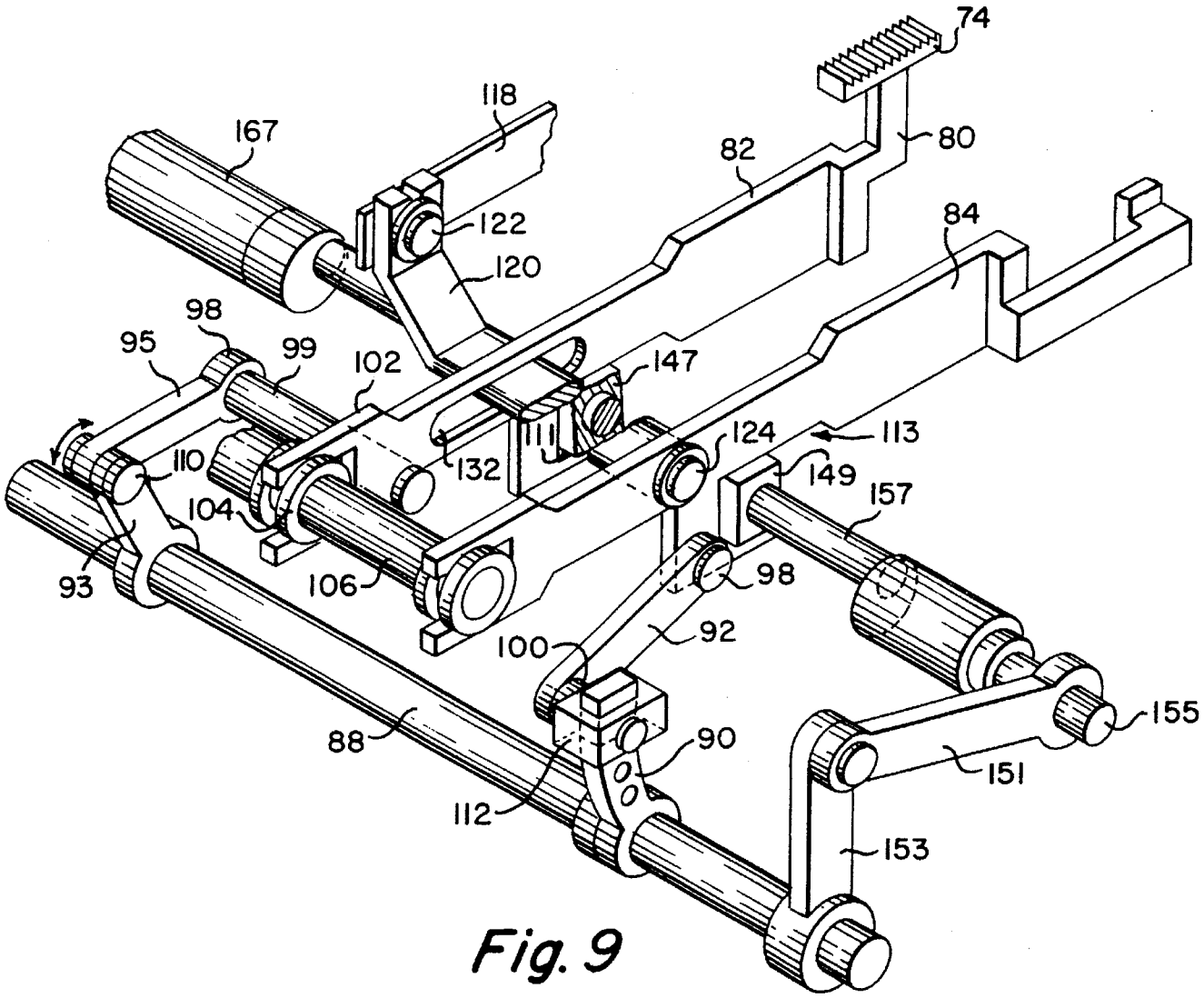
FIG. 9 is a perspective view of the lower walking foot of the apparatus of FIG. 1.

Now referring to FIG. 9, the linkage previously discussed with reference to FIG. 6 is shown, but with the modification that lower feed 76 and bar 86 are removed with known techniques. As such, the modified machine has one lower feed 74 only. As discussed, above this feed 74 operates at a fixed rate. The upper feed 72 is still attached by arm 120 to linkage that provides a variable feed rate, as discussed above. Consequently, an overfeed may be implemented by repositioning pivot point 100, as discussed above.

Because operators may want to adjust and re-adjust the overfeed rate during the taping application, another aspect of the invention includes a pneumatic system 300 to conviently reposition the pivot point 100.

Figure 10:
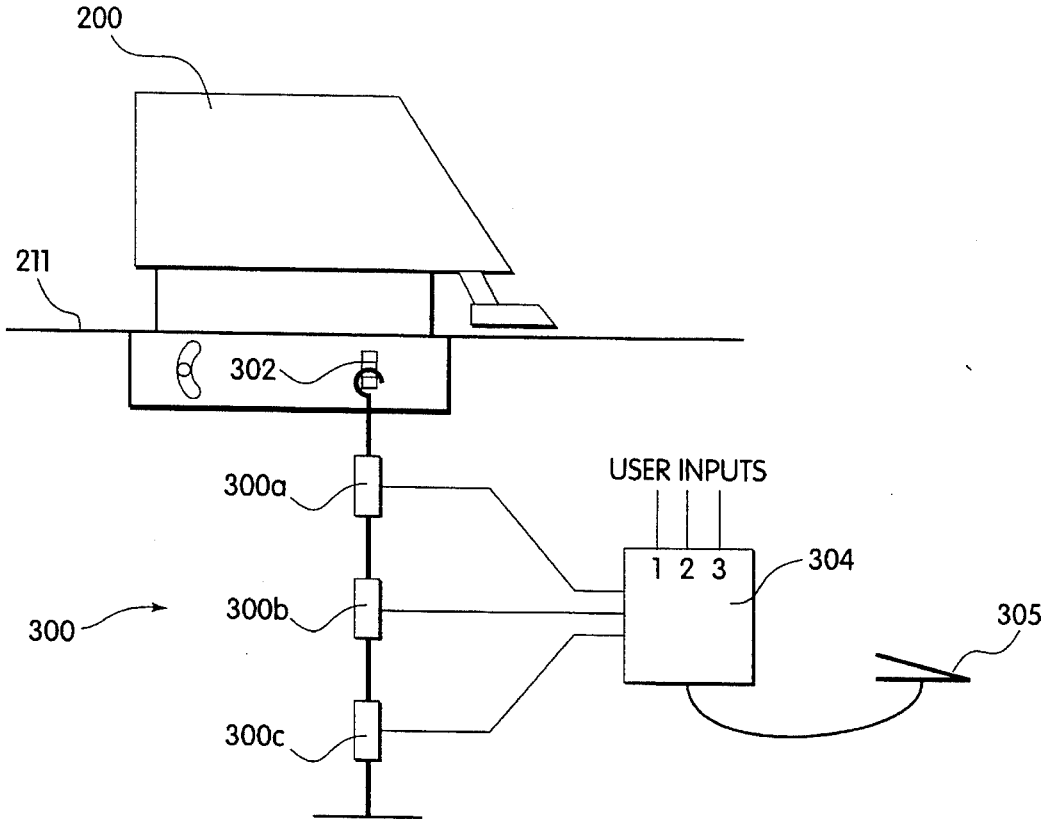
FIG. 10 illustrates a pneumatic system of the apparatus of FIG. 1.

As discussed above, the pivot point is typically adjusted manually. FIG. 10 illustrates a view of the external casing of the stitcher 200 with lever 302. Typically, a lock nut is manually loosened and lever 302 is moved to cause the repositioning of pivot point 100 and member 90.

However, in the present invention, lever 302 is connected to pneumatic system 300 which has three pistons 300*a–c* connected in series. Each piston may be independently activated under user control 304 and all three may be activated with a foot pedal 305 with known techniques. Consequently, the user may adjust the overfeed with the user control 304. The desired rate of overfeed will depend on the ratio of the edge lengths and the type of the materials that are to be joined. If a user needs "bursts" of high overfeed, he or she will likely desire to activate the pistons 300*a–c* with the foot pedal.

Figure 11:
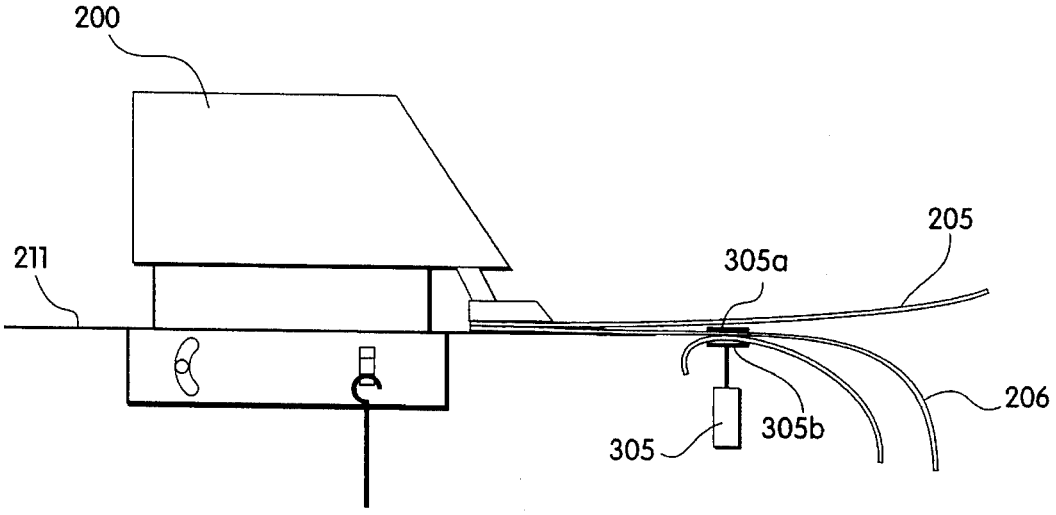
FIG. 11 illustrates a partial cut away perspective view of the apparatus of FIG. 1.
Figure 12:
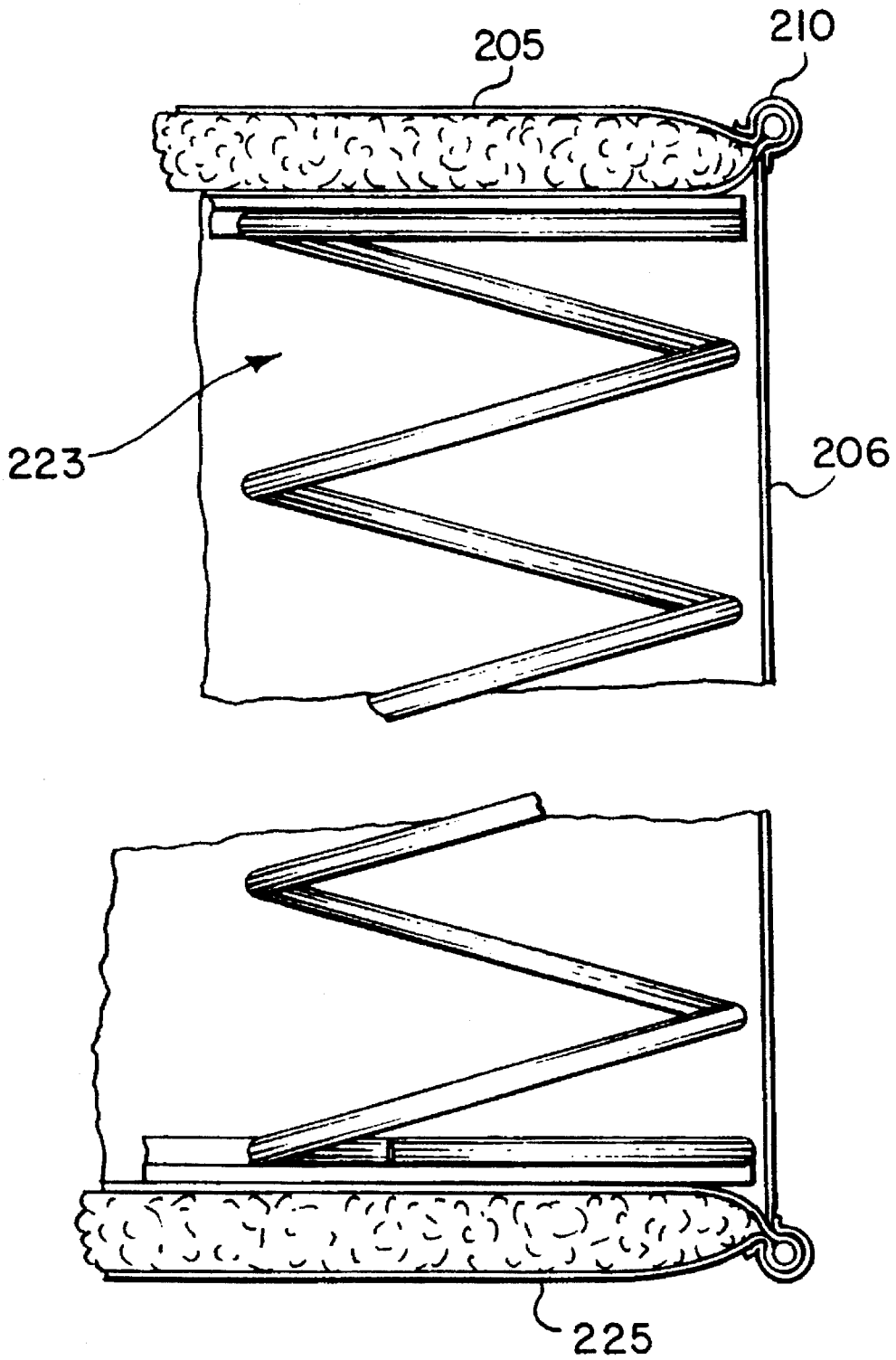
FIG. 12 is a diagram illustrating the structure of a conventional mattress sack.

FIG. 11 illustrates the invention in side view, in conjunction with a pneumatic drag foot 305. The foot 305 has side panel 206 pass between its plates 305*a* and *b*. Under user control, the drag foot may introduces a variable amount of drag to the side panel 206 to keep the side panel taut and assist in the overfeed of a top panel having a longer edge lenth.

The method of forming a partial mattress sack will now be described with reference to FIGS. 1–12. The modified machine is adjusted to implement a desired amount of overfeed, which will, as discussed below, depend upon the sizes of the panels and the types of materials used. A side panel 206 is loaded into the modified machine, preferably, passing the side panel 206 between two drag plates 305*a* and 305*b*. The plates 305*a* and 305*b* provide a variable amount of drag to the side panel to keep it taut. A top panel 205 is also loaded into the machine. The top panel has a first edge length, and the side panel has a second edge length, which is shorter than the first edge length. For example, the first edge may be 205 inches, and the second edge may be 200 inches. The two panels are then joined around the entire peripheral edge of the top panel by the modified machine. The modified machine uses a top feed 72 which moves at a first rate, and a bottom feed 74 which moves at a second rate. The overfeed, i.e., the difference in feeding rates, allows a longer edged top panel to be fed along with a shorter side panel. Preferably, a safety stitch and tape are used to join the materials. The joined top and bottom panel form a partial sack.

Afterwards, an operator will fit the partial sack to an inner construction 225. A bottom panel 225 of a first length will then be joined to the side panel of the second length with a tape edge machine or the like. This will require the skilled labor of manually fitting the longer bottom panel to the shorter side panel, but as readily seen, this skilled operation is needed for one edge of the side panel only.

Having thus described one particular embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A method for forming a partial mattress sack having a first panel and a second panel to prevent radial bunching of the second panel after assembly of the mattress sack, the method comprising the steps of:

a) feeding the first panel at a first rate into a stitcher, the first panel having a first edge length;

b) feeding the second panel at a second rate into the stitcher, the second panel having a second edge length, shorter than the first edge length, the, second rate being less than the first rate; and c) sewing the first panel to the second panel with the stitcher to form the partial sack.

2. The method of claim 1 wherein the ratio of the second rate to the first rate is substantially equal to the ratio of the second edge length in relation to the first edge length.

3. The method of claim 1 wherein said sewing step (c) further includes the step of sewing the first panel to the second panel with a high lift safety stitch.

4. The method of claim 1 wherein said sewing step (c) further includes the step of sewing the first panel to the second panel together with a binding tape using a high lift safety stitch.

5. A method for closing a mattress with a mattress sack having a top panel, a bottom panel and a side panel so that the side panel does not display radial bunching after closing of the mattress, the method comprising the steps of:

(a) feeding at a first rate the top panel of the mattress sack, the top panel having a first edge length;

(b) feeding at a second rate the side panel of the mattress sack, the side panel having a second edge length shorter than the first edge length, the second rate being less than the first rate;

(c) sewing the top panel to the side panel using a high lift safety stitch to form a partial mattress sack;

(d) inserting an inner construction of the mattress into the partial mattress sack; and (e) joining a bottom panel to a second edge of the side panel.

6. Apparatus for forming a partial mattress sack having a top panel and a side panel, the apparatus comprising:

a sewing machine for stitching the top panel to the side panel;

a first lower walking foot bar having a lower walking foot disposed thereon;

a second lower walking foot bar;

an upper walking foot bar having an upper walking foot disposed thereon, said upper walking foot being disposed above said lower walking foot for cooperating with said lower walking foot for feeding the top and side panels of the partial mattress sack to the sewing machine;

apparatus for driving said first lower walking foot bar and said lower foot in an elliptical path at a fixed speed;

apparatus for driving said second lower walking foot bar in an elliptical path at a second speed; and a member directly connecting said upper walking foot bar to said second lower walking foot bar such that the motion of said upper walking foot bar and foot is responsive to the motion of said second lower walking foot bar.

7. The apparatus as recited in claim 6 wherein said connecting member comprises an arm fixedly attached to said second lower walking foot bar driving apparatus, said arm passing through a slot in said first lower walking foot bar, whereby said arm can slide freely in said slot when said fixed speed of said lower foot is different from the second speed of said second lower walking foot bar.

8. The apparatus as recited in claim 6 further comprising apparatus for adjusting the second speed of said second lower walking foot bar and said upper walking foot bar relative to the fixed speed of said first walking foot bar.

9. The apparatus as recited in claim 8 wherein said varying apparatus comprises a plurality of pneumatic pistons and apparatus for selectively activating each of said pneumatic pistons, activation of a piston producing a predetermined speed for said upper walking foot bar.

10. The apparatus as recited in claim 9 wherein said pistons are coupled to a lever which adjusts the speed of said second lower walking foot bar.

11. The apparatus as recited in claim 9 wherein said selectively activating apparatus comprises a foot pedal.

12. The apparatus as recited in claim 6 wherein said apparatus for driving said first lower walking foot bar comprises a reciprocating shaft and a first arm assembly coupling said reciprocating shaft to said first lower walking foot bar and wherein said apparatus for driving said second lower walking foot bar comprises said reciprocating shaft and a second arm assembly coupling said second lower walking foot bar to said reciprocating shaft.

13. The apparatus as recited in claim 12 wherein said second arm assembly comprises first and second arm members joined at a pivot and wherein a location of said pivot is adjustable along a length of said first arm member.

14. The apparatus as recited in claim 13 wherein said pivot comprises a pin fixed to said second arm member and wherein said first arm member has a plurality of holes through which said pin may pass, said second speed of said second lower walking foot bar relative to said fixed speed of said first lower walking foot bar being determined by a location of a hole within which said pin is positioned.

* * * * *